US010140913B2

(12) United States Patent
Chen

(10) Patent No.: US 10,140,913 B2
(45) Date of Patent: Nov. 27, 2018

(54) SHIFT REGISTER UNIT, GATE DRIVE CIRCUIT AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventor: Huabin Chen, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/539,115

(22) PCT Filed: Oct. 18, 2016

(86) PCT No.: PCT/CN2016/102404
§ 371 (c)(1),
(2) Date: Jun. 22, 2017

(87) PCT Pub. No.: WO2017/118141
PCT Pub. Date: Jul. 13, 2017

(65) Prior Publication Data

US 2018/0268755 A1 Sep. 20, 2018

(30) Foreign Application Priority Data

Jan. 4, 2016 (CN) ..... 2016 2 0006125 U

(51) Int. Cl.
*G09G 3/3266* (2016.01)
*G09G 3/22* (2006.01)

(52) U.S. Cl.
CPC ..... *G09G 3/22* (2013.01); *G09G 3/3266* (2013.01); *G09G 2300/0842* (2013.01); *G09G 2310/0286* (2013.01); *G09G 2310/08* (2013.01)

(58) Field of Classification Search
CPC ..... G11C 19/38; G11C 27/04; G11C 29/20; G11C 19/00; G11C 27/00; G11C 19/184; G09G 2310/0286; G09G 3/3266
See application file for complete search history.

(56) References Cited

U.S. PATENT DOCUMENTS

2008/0080661 A1 4/2008 Tobita
2014/0185737 A1 7/2014 Jang
2017/0039968 A1 2/2017 Chen et al.

FOREIGN PATENT DOCUMENTS

CN 101221818 A 7/2008
CN 103915058 A 7/2014
(Continued)

OTHER PUBLICATIONS

International Search Report and Written Opinion in PCT/CN2016/102404 dated Jan. 24, 2017, with English translation.

*Primary Examiner* — Rodney Amadiz
(74) *Attorney, Agent, or Firm* — Womble Bond Dickinson (US) LLP

(57) ABSTRACT

The shift register unit comprises: a gate drive signal output terminal, a first clock signal input terminal, a second clock signal input terminal, a low level input terminal, a pull-up control unit, a pull-down unit, a pull-down node control unit and a pull-down control node control unit. In a pull-down holding phase of a display period, a first clock signal input through the first clock signal input terminal and a second clock signal input through the second clock signal input terminal have opposite phases. When the first clock signal has a high level, the pull-down control node control unit
(Continued)

controls the pull-down control node to be connected to the first clock signal input terminal. When the second clock signal has a high level, the pull-down control node control unit controls the pull-down control node to be connected to the low level input terminal.

20 Claims, 7 Drawing Sheets

(56) References Cited

FOREIGN PATENT DOCUMENTS

| | | | |
|---|---|---|---|
| CN | 104732939 | A | 6/2015 |
| CN | 205282053 | U | 6/2016 |
| KR | 20110077108 | A | 7/2011 |

SHIFT REGISTER UNIT, GATE DRIVE CIRCUIT AND DISPLAY DEVICE

RELATED APPLICATION

This application claims the benefit of a patent application, "Shift Register Unit, Gate Drive Circuit and Display Device", No. 201620006125.X for utility model in China filed on Jan. 4, 2016, the full disclosure of which is incorporated herein by way of reference.

TECHNICAL FIELD

The present disclosure relates to the technical field of display, in particular to a shift register unit, a gate drive circuit and a display device.

BACKGROUND

As shown in FIG. 1, in the design for a Gate On Array (GOA) of a Thin Film Transistor-liquid Crystal Display (TFT-LCD) in the prior art, the time for charging a pull-down node PD in a pull-down holding phase T4 is a 50% time, i.e. a time period in which a first clock signal CLKB has a high level. In the other half of time, i.e. a time period in which the CLKB has a low level, since a pull-down control node PD_CN cannot be turned off well, the potential of the pull-down node PD is pulled down with a second clock signal CLK, and noises of a pull-up node PU and a gate drive signal are large (in FIG. 1, Input indicates an input signal). That is to say, during the pull-down holding phase T4, when the first clock signal CLKB has a high level, the potential of the pull-down control node PD_CN can remain at a high level, so that the pull-down node PD switches to the first clock signal CLKB, and the potential of the pull-down node PD also becomes a high level. When the first clock signal CLKB has a low level, the potential of the pull-down control node PD_CN still remains at a high level, so that the potential of the pull-down node PD is pulled down, which might cause erroneous output at a gate drive signal output terminal.

SUMMARY

Embodiments of the present disclosure provide a shift register unit, a gate drive circuit and a display device to at least partially alleviate the problem that in the pull-down holding phase of a display period, since the potential of the pull-down control node PD_CN cannot remain at a low level, the pull-down node PD has an electric leakage, resulting in noises of the gate drive signal and the pull-up node.

One embodiment of the present disclosure provides a shift register unit, comprising:

a gate drive signal output terminal, a first clock signal input terminal, a second clock signal input terminal, a low level input terminal, a pull-up control unit, a pull-down unit, a pull-down node control unit and a pull-down control node control unit;

a pull-up node disposed between the pull-up control unit and the pull-down node control unit;

a pull-down node disposed between the pull-down unit and the pull-down node control unit; and a pull-down control node disposed between the pull-down control node control unit and the pull-down node control unit.

The pull-up control unit is connected to the gate drive signal output terminal and the pull-up node. In the input phase and output phase of the display period, the pull-up control unit pulls the potential of the pull-up node up to a high level. In the output phase of the display period, the pull-up control unit controls the gate drive signal output terminal to output a high level.

The pull-down unit is connected to the pull-down node and the gate drive signal output terminal. In a pull-down holding phase of the display period, the pull-down unit controls the gate drive signal output terminal to output a low level under the control of the pull-down node.

The pull-down node control unit is connected to the first clock signal input terminal, the pull-up node, the pull-down node, the pull-down control node and the low-level input terminal. In the input phase and output phase of the display period, the pull-down node control unit controls the pull-down node to be connected to the low-level input terminal under the control of the pull-up node. In a pull-down holding phase of the display period, the pull-down node control unit controls the pull-down node to be connected to the first clock signal input terminal under the control of the pull-down control node.

The pull-down control node control unit is connected to the first clock signal input terminal, the second clock signal input terminal, the low level input terminal and the pull-down control node. In the pull-down holding phase of the display period, the first clock signal input through the first clock signal input terminal and the second clock signal input through the second clock signal input terminal have opposite phases. When the first clock signal has a high level, the pull-down control node control unit controls the pull-down control node to be connected to the first clock signal input terminal. When the second clock signal has a high level, the pull-down control node control unit controls the pull-down control node to be connected to the low level input terminal.

In one embodiment, the pull-down control node control unit comprises a first pull-down control node control module and a second pull-down control node control module.

The first pull-down control node control module is connected to the pull-down control node, the second clock signal input terminal and the low level input terminal. In the pull-down holding phase of the display period, when the second clock signal has a high level, the first pull-down control node control module controls the pull-down control node to be connected to the low-level input terminal.

The second pull-down control node control module is connected to the first clock signal input terminal and the pull-down control node. In the pull-down holding phase of the display period, when the first clock signal has a high level, the second pull-down control node control module controls the pull-down control node to be connected to the first clock signal input terminal.

In one embodiment, the first pull-down control node control module comprises a first pull-down control node control transistor, with its gate connected to the second clock signal input terminal, its first pole connected to the pull-down control node, and its second pole connected to the low level input terminal.

In one embodiment, the second pull-down control node control module comprises a second pull-down control node control transistor, with its gate and first pole both connected to the first clock signal input terminal, and its second pole connected to the pull-down control node.

In one embodiment, the pull-down control node control unit further comprises a third pull-down control node control module connected to the pull-down control node, the pull-up node and the low level input terminal. In the input phase and output phase of the display period, the third pull-down control node control module controls the pull-down control node to be connected to the low level input terminal under the control of the pull-up node.

In one embodiment, the third pull-down control node control module comprises a third pull-down control node control transistor, with its gate connected to the pull-up node, its first pole connected to the pull-down control node, and its second pole connected to the low level input terminal.

In one embodiment, the pull-down node control unit comprises: a first pull-down node control transistor, with its gate connected to the pull-up node, its first pole connected to the pull-down node and its second pole connected to the low level input terminal; and a second pull-down node control transistor with its gate connected to the pull-down control node, its first pole connected to the first clock signal input terminal, and its second pole connected to the pull-down node.

In one embodiment, the pull-down unit comprises a pull-down transistor, with its gate connected to the pull-down node, its first pole connected to the gate drive signal output terminal, and its second pole connected to the low level input terminal.

In one embodiment, the shift register unit further comprises an input terminal. The pull-up control unit comprises an input module, a memory capacitor, a pull-up node reset module and a pull-up module.

The input module is connected to the input terminal and the pull-up node. In the input phase of the display period, the input module pulls the potential of the pull-up node to a high level.

A first end of the memory capacitor is connected to the pull-up node, and a second end of the memory capacitor is connected to the gate drive signal output terminal. In the output phase of the display period, the memory capacitor bootstraps a pull-up of the potential of the pull-up node.

The pull-up node reset module is connected to the pull-down node, the pull-up node and the low level input terminal. When the potential of the pull-down node has a high level, the pull-up node reset module controls the potential of the pull-up node to be a low level.

The pull-up module is connected to the pull-up node, the second clock signal input terminal and the gate drive signal output terminal. When the potential of the pull-up node has a high level, the pull-up module controls the gate drive signal output terminal to be connected to the second clock signal input terminal.

In one embodiment, the input module comprises an input transistor, with its gate and first pole connected to the input terminal, and its second pole connected to the pull-up node.

The pull-up node reset module comprises a pull-up node reset transistor, with its gate connected to the pull-down node, its first pole connected to the pull-up node and its second pole connected to the low level input terminal.

The pull-up module comprises a pull-up transistor, with its gate connected to the pull-up node, its first pole connected to the second clock signal input terminal and its second pole connected to the gate drive signal output terminal.

In one embodiment, the shift register unit further comprises a reset terminal and a reset unit.

The reset unit is connected to the reset terminal, the pull-up node, the gate drive signal output terminal and the low level input terminal. When signals input through the reset terminal have a high level, the reset unit controls the pull-up node and the gate drive signal output terminal to be connected to the low level input terminal.

In one embodiment, the reset unit comprises:

a first reset transistor, with its gate connected to the reset terminal, its first pole connected to the pull-up node and its second pole connected to the low level input terminal; and a second reset transistor, with its gate connected to the reset terminal, its first pole connected to the gate drive signal output terminal and its second pole connected to the low level input terminal.

One embodiment of the present disclosure provides a gate drive circuit, comprising multiple stages of the above described shift register units.

In one embodiment, each of the shift register units comprises a reset terminal and an input terminal.

Except for a first stage of shift register unit, the input terminal of each stage of shift register unit is connected the gate drive signal output terminal of a previous adjacent stage of shift register unit.

Except for a last stage of shift register unit, the reset terminal of each stage of shift register unit is connected the gate drive signal output terminal of a next adjacent stage of shift register unit.

One embodiment of the present disclosure provides a display device, comprising the above-mentioned gate drive circuit.

Compared to the prior art, the shift register unit, gate drive circuit and display device provided by the embodiments of the present disclosure use the pull-down control node control unit to at least partially alleviate the problem that in the pull-down holding phase of a display period, since the potential of the pull-down control node cannot remain at a low level, the pull-down node has an electric leakage, resulting in noises of the gate drive signal and the pull-up node.

DETAILED DESCRIPTION OF THE EMBODIMENTS

Technical solutions in each embodiment of the present application will be now described clearly and completely with reference to the drawings. Obviously, the described embodiments are only some, instead of all, of the embodiments of the present application. All other embodiments that can be obtained by those ordinarily skilled in the art on the basis of the embodiments in the present application without using any inventive effort shall fall into the protection scope of the present application.

Figure 1:
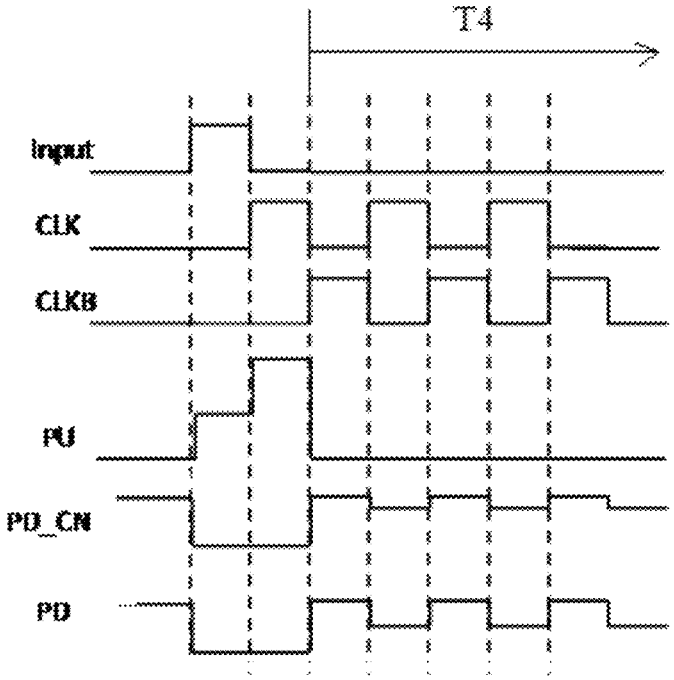
FIG. 1 is a timing diagram of an existing shift register unit.
Figure 2:
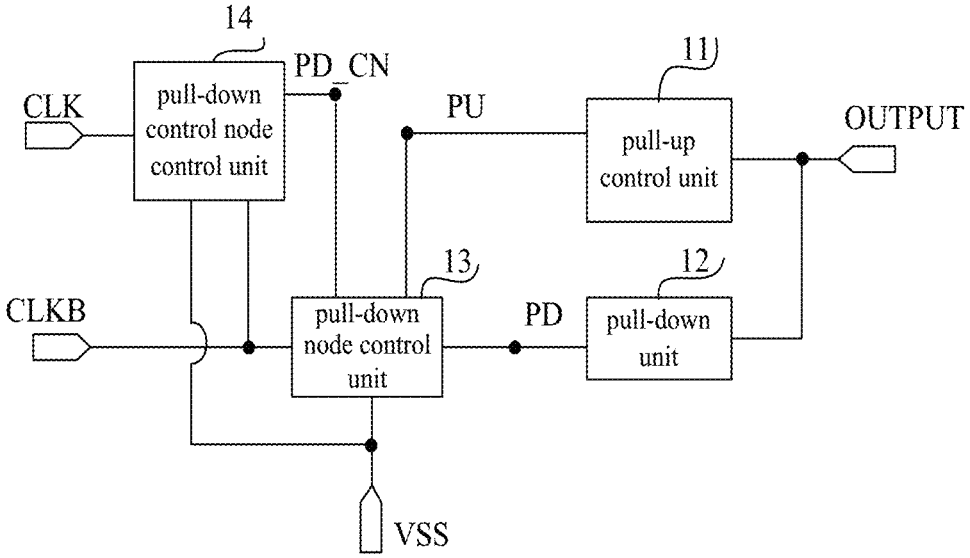
FIG. 2 is a structural diagram of a shift register unit according to one embodiment of the present disclosure.

As shown in FIG. 2, a shift register unit comprises: a gate drive signal output terminal OUTPUT, a first clock signal input terminal (i.e. a terminal through which a first clock signal CLKB is input), a second clock signal input terminal (i.e. a terminal through which a second clock signal CLK is input), a low level input terminal (i.e. a terminal for inputting a low level VSS), a pull-up control unit 11, a pull-down unit 12, a pull-down node control unit 13 and a pull-down control node control unit 14.

A pull-up node PU is disposed between the pull-up control unit 11 and the pull-down node control unit 13. A pull-down node PD is disposed between the pull-down unit 12 and the pull-down node control unit 13. A pull-down control node PD_CN is disposed between the pull-down control node control unit 14 and the pull-down node control unit 13.

The pull-up control unit 11 is connected to the gate drive signal output terminal OUTPUT and the pull-up node PU. In an input phase and output phase of a display period, the pull-up control unit 11 pulls the potential of the pull-up node PU up to a high level. In an output phase of the display period, the pull-up control unit 11 controls the gate drive signal output terminal OUTPUT to output a high level.

The pull-down unit 12 is connected to the pull-down node and the gate drive signal output terminal OUTPUT. In a pull-down holding phase of the display period, the pull-down unit 12 controls the gate drive signal output terminal OUTPUT to output a low level under the control of the pull-down node PD.

The pull-down node control unit 13 is connected to the first clock signal input terminal, the pull-up node PU, the pull-down node PD, the pull-down control node PD_CN and the low-level input terminal. In the input phase and output phase of the display period, the pull-down node control unit 13 controls the pull-down node PD to be connected to the low-level input terminal under the control of the pull-up node. In a pull-down holding phase of the display period, the pull-down node control unit 13 controls the pull-down node PD to be connected to the first clock signal input terminal under the control of the pull-down control node PD_CN.

The pull-down control node control unit 14 is connected to the first clock signal input terminal, the second clock signal input terminal, the low level input terminal and the pull-down control node PD_CN. In the pull-down holding phase of the display period, the first clock signal CLKB input through the first clock signal input terminal and the second clock signal CLK input through the second clock signal input terminal have opposite phases. When the first clock signal CLKB has a high level, the pull-down control node control unit 14 controls the pull-down control node PD_CN to be connected to the first clock signal input terminal. When the second clock signal CLK has a high level, the pull-down control node control unit 14 controls the pull-down control node PD_CN to be connected to the low level input terminal.

The shift register unit uses the pull-down control node control unit 14 to at least partially alleviate the problem that in the pull-down holding phase of a display period, since the potential of the pull-down control node PD_CN cannot remain at a low level, the pull-down node PD has an electric leakage, resulting in noises of the gate drive signal and the pull-up node.

Figure 3:
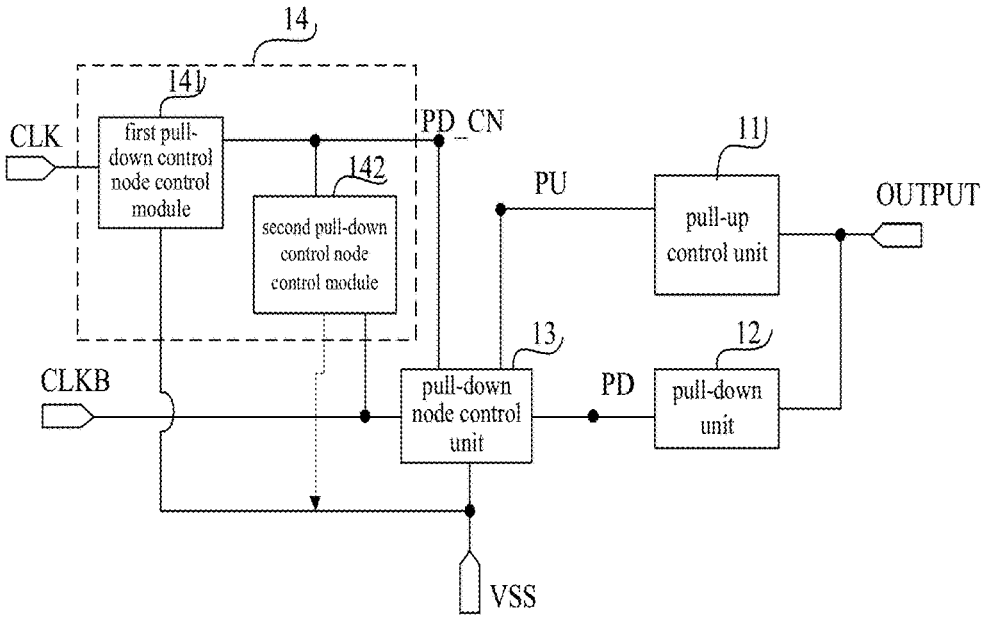
FIG. 3 is a circuit diagram of a shift register unit according to one embodiment of the present disclosure.

As shown in FIG. 3, the pull-down control node control unit 14 comprises a first pull-down control node control module 141 and a second pull-down control node control module 142.

The first pull-down control node control module 141 is connected to the pull-down control node PD_CN, the second clock signal input terminal and the low level input terminal. In the pull-down holding phase of the display period, when the second clock signal CLK has a high level, the first pull-down control node control module 141 controls the pull-down control node PD_CN to be connected to the low-level input terminal.

The second pull-down control node control module 142 is connected to the first clock signal input terminal and the pull-down control node PD_CN. In the pull-down holding phase of the display period, when the first clock signal CLKB has a high level, the second pull-down control node control module 142 controls the pull-down control node PD_CN to be connected to the first clock signal input terminal.

In the shift register unit as shown in FIG. 3, the pull-down control node control unit 14 is divided into a first pull-down control node control module 141 and a second pull-down control node control module 142. In the pull-down holding phase of the display period, when the second clock signal CLK has a high level, the first pull-down control node control module 141 controls the pull-down control node PD_CN to be connected to the low-level input terminal, so as to prevent the output noises in the pull-down holding phase caused by pull-down of the potential of PD resulted from the high level of the potential of PD_CN when CLKB has a low level.

Figure 4:
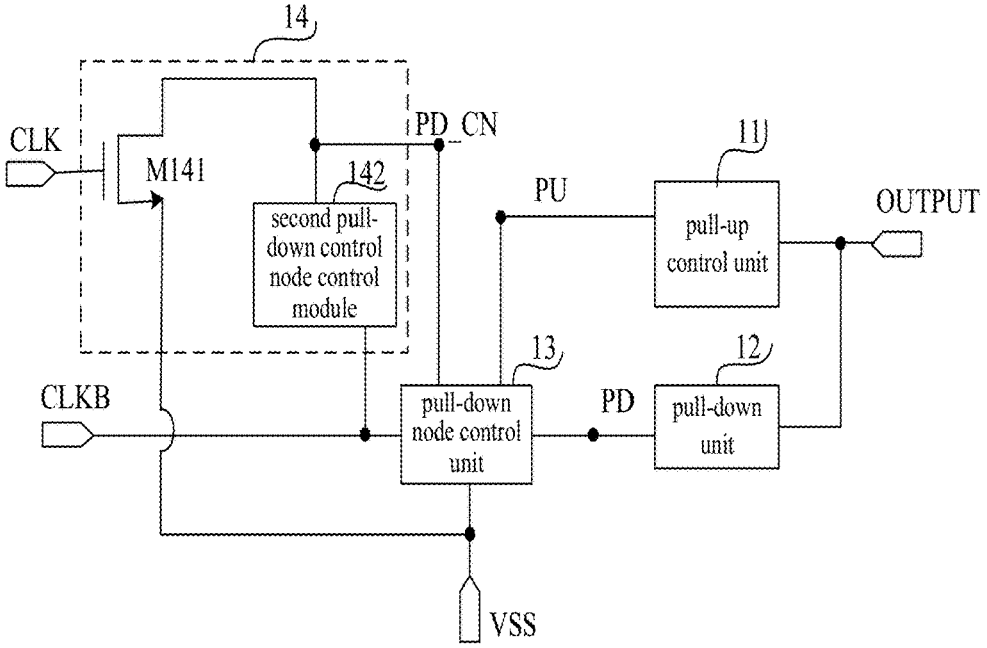
FIG. 4 is a circuit diagram of a shift register unit according to another embodiment of the present disclosure.

As shown in FIG. 4, the first pull-down control node control module comprises a first pull-down control node control transistor M141, with its gate connected to the second clock signal input terminal, its first pole connected to the pull-down control node PD_CN, and its second pole connected to the low level input terminal.

Figure 5:
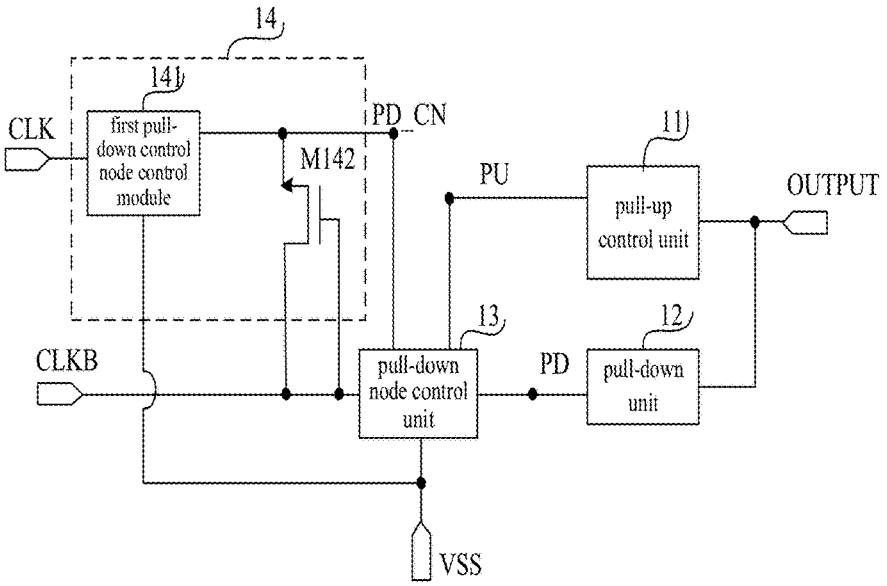
FIG. 5 is a circuit diagram of a shift register unit according to still another embodiment of the present disclosure.

As shown in FIG. 5, the second pull-down control node control module comprises a second pull-down control node control transistor M142, with its gate and first pole both connected to the first clock signal input terminal, and its second pole connected to the pull-down control node PD_CN.

Figure 6:
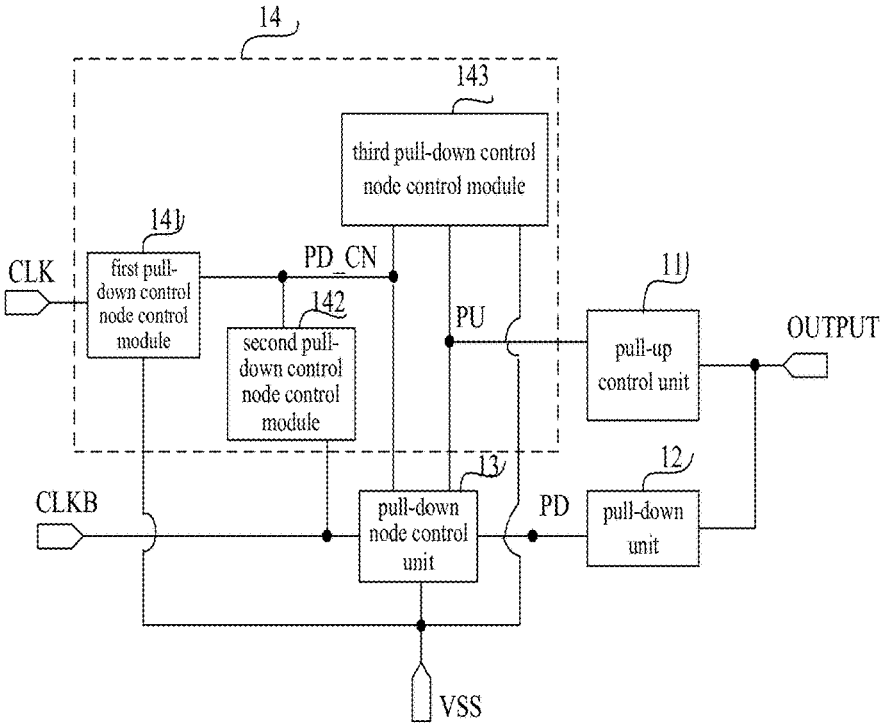
FIG. 6 is a circuit diagram of a shift register unit according to still another embodiment of the present disclosure.

As shown in FIG. 6, the pull-down control node control unit 14 further comprises a third pull-down control node control module 143, which is connected to the pull-down control node PD_CN, the pull-up node PU and the low level input terminal. In the input phase and output phase of the display period, the third pull-down control node control module 143 controls the pull-down control node PD_CN to be connected to the low level input terminal under the control of the pull-up node PU.

The shift register unit as shown in FIG. 6 controls the pull-down control node PD_CN to switch to a low level through the third pull-down control node control module 143 comprised in the pull-down control node control unit 14, in the input phase and output phase of the display period (in which the potential of the PU has a high level). Thereby, the potential of the pull-down node PD will be prevented from being pulled down due to the high level of the potential of PD_CN.

Figure 7:
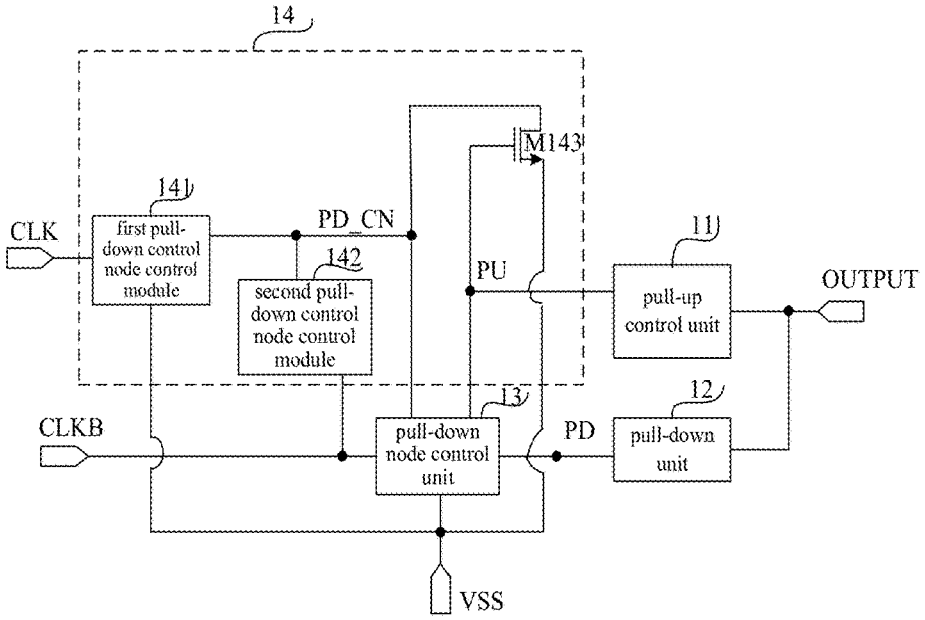
FIG. 7 is a circuit diagram of a shift register unit according to still another embodiment of the present disclosure.

As shown in FIG. 7, the third pull-down control node control module comprises a third pull-down control node control transistor M143, with its gate connected to the pull-up node PU, its first pole connected to the pull-down control node PD_CN, and its second pole connected to the low level input terminal.

The pull-down node control unit may comprise:

a first pull-down node control transistor, with its gate connected to the pull-up node PU, its first pole connected to the pull-down node PD and its second pole connected to the low level input terminal; and a second pull-down node control transistor, with its gate connected to the pull-down control node PD_CN, its first pole connected to the first clock signal input terminal, and its second pole connected to the pull-down node PD.

The pull-down unit may comprise: a pull-down transistor, with its gate connected to the pull-down node PD, its first pole connected to the gate drive signal output terminal, and its second pole connected to the low level input terminal.

As for specific circuit structures of the above-mentioned pull-down node control unit and pull-down unit, they will be described in further detail later with reference to the drawings.

Figure 8:
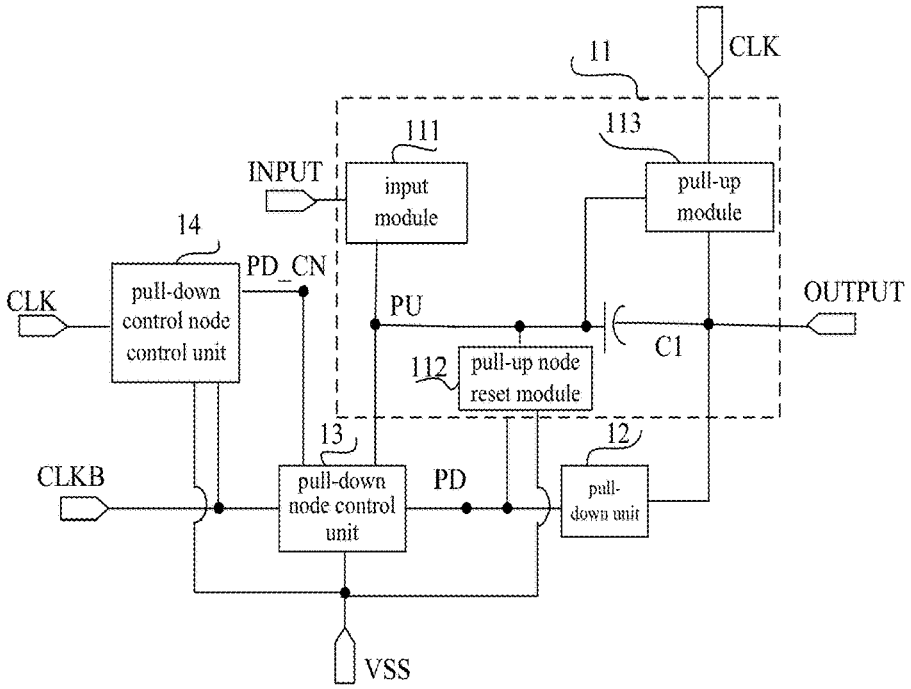
FIG. 8 is a circuit diagram of a shift register unit according to still another embodiment of the present disclosure.

As shown in FIG. 8, the shift register unit further comprises an input terminal INPUT. The pull-up control unit 11 comprises an input module 111, a memory capacitor C1, a pull-up node reset module 112 and a pull-up module 113.

The input module 111 is connected to the input terminal INPUT and the pull-up node PU. In the input phase of the display period, the input module 111 pulls the potential of the pull-up node PU up to a high level.

A first end of the memory capacitor C1 is connected to the pull-up node PU, and a second end of the memory capacitor C1 is connected to the gate drive signal output terminal OUTPUT. In the output phase of the display period, the memory capacitor C1 bootstraps a pull-up of the potential of the pull-up node.

The pull-up node reset module 112 is connected to the pull-down node PD, the pull-up node PU and the low level input terminal. When the potential of the pull-down node PD has a high level, the pull-up node reset module 112 controls the potential of the pull-up node PU to be a low level.

The pull-up module 113 is connected to the pull-up node PU, the second clock signal input terminal and the gate drive signal output terminal OUTPUT. When the potential of the pull-up node PU has a high level, the pull-up module 113 controls the gate drive signal output terminal OUTPUT to be connected to the second clock signal input terminal.

The shift register unit as shown in FIG. 8 has an input terminal INPUT added. In the input phase of the display period, the input terminal INPUT switches to a high level. Thus, the input module 111 included in the pull-up control unit 11 can pull the potential of the pull-up node PU up to a high level. In the output phase of the display period, the memory capacitor bootstraps a pull-up of the potential of the pull-up node PU. The pull-up module 113 comprised in the pull-up control unit 11 controls the gate drive signal output terminal OUTPUT to receive the second clock signal CLK when the potential of the pull-up node PU has a high level (i.e. in the input phase and output phase of the display period).

The input module may comprise: an input transistor, with its gate and first pole both connected to the input terminal INPUT, and its second pole connected to the pull-up node PU.

The pull-up node reset module may comprise a pull-up node reset transistor, with its gate connected to the pull-down node PD, its first pole connected to the pull-up node PU and its second pole connected to the low level input terminal.

The pull-up module may comprise a pull-up transistor, with its gate connected to the pull-up node PU, its first pole connected to the second clock signal input terminal, and its second pole connected to the gate drive signal output terminal OUTPUT.

Specific circuit structures of the above-mentioned input module and pull-up module will be described in further detail later with reference to the drawings.

Figure 9:
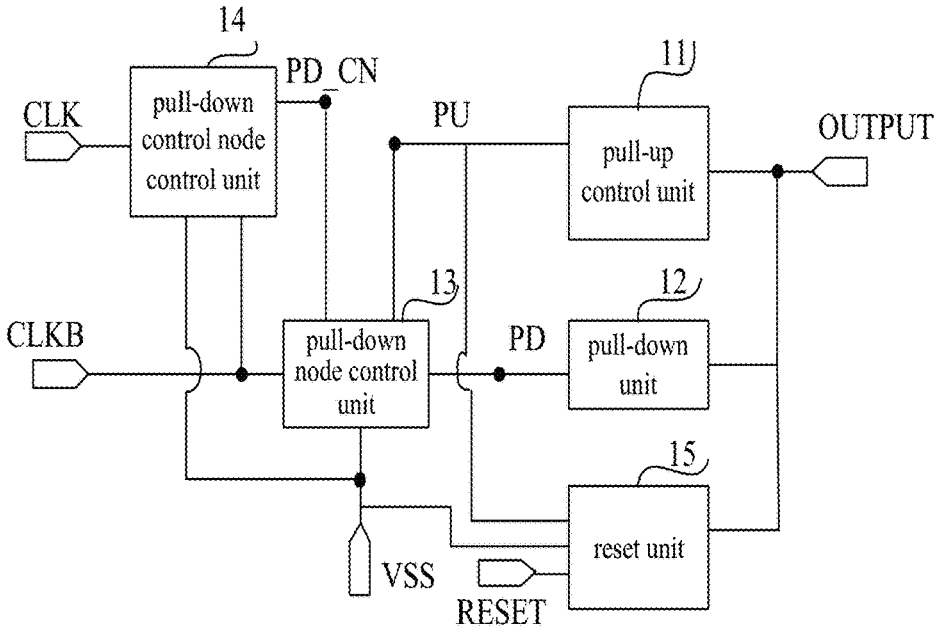
FIG. 9 is a circuit diagram of a shift register unit according to still another embodiment of the present disclosure.

As shown in FIG. 9, the shift register unit further comprises a reset terminal RESET and a reset unit 15.

The reset unit 15 is connected to the reset terminal RESET, the pull-up node PU, the gate drive signal output terminal OUTPUT and the low level input terminal. When signals input through the reset terminal are of a high level, the reset unit 15 controls the pull-up node PU and the gate drive signal output terminal OUTPUT to be both connected to the low level input terminal. A low level VSS is input through the low level input terminal.

The shift register unit as shown in FIG. 9 further employs a reset unit 15. When the reset terminal RESET switches to a high level, the reset unit 15 controls the pull-up node PU and the gate drive signal output terminal OUTPUT to switch to a low level VSS. During actual operations, the reset terminal RESET can be controlled to output a high level at the very beginning of the pull-down holding phase of the display period, thereby further pulling down the potential of the pull-up node PU and the gate drive signal.

The reset unit comprises:

a first reset transistor, with its gate connected to the reset terminal, its first pole connected to the pull-up node PU and its second pole connected to the low level input terminal; and a second reset transistor, with its gate connected to the reset terminal, its first pole connected to the gate drive signal output terminal, and its second pole connected to the low level input terminal.

Specific circuit structure of the above-mentioned reset unit will be described in further detail later with reference to the drawings.

A specific circuit diagram of the shift register unit will be illustrated below by means of an embodiment.

Figure 10:
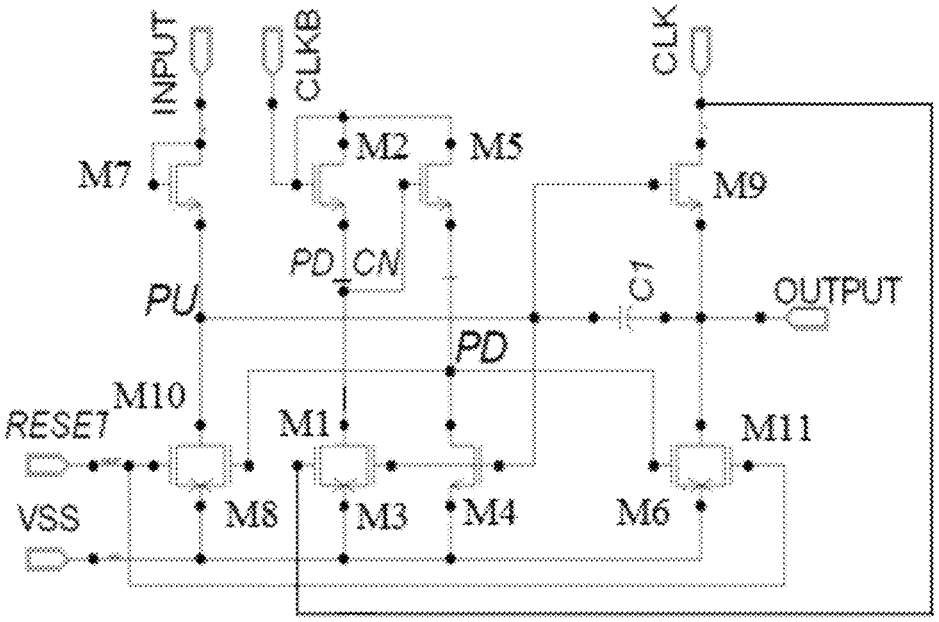
FIG. 10 is a specific circuit diagram of a shift register unit according to yet another embodiment of the present disclosure.

As shown in FIG. 10, the shift register unit comprises a gate drive signal output terminal OUTPUT, an input terminal INPUT, a reset terminal RESET, a pull-up control unit, a pull-down unit, a pull-down node control unit, a pull-down control node control unit and a reset unit.

The pull-down control node control unit comprises:

a first pull-down control node control transistor M1, with its gate connected to the second clock signal input terminal through which the second clock signal CLK is input, its first pole connected to the pull-down control node PD_CN, and its second pole connected to the low level input terminal through which the low level VSS is input;

a second pull-down control node control transistor M2, with its gate and first pole connected to the first clock signal input terminal through which the first clock signal CLKB is input, and its second pole connected to the pull-down control node PD_CN; and a third pull-down control node control transistor M3, with its gate connected to the pull-up node PU, its first pole connected to the pull-down control node PD_CN, and its second pole connected to the low level input terminal.

The pull-down node control unit comprises:

a first pull-down node control transistor M4, with its gate connected to the pull-up node PU, its first pole connected to the pull-down node PD, and its second pole connected to the low level input terminal; and a second pull-down node control transistor M5, with its gate connected to the pull-down control node PD_CN, its first pole connected to the first clock signal input terminal, and its second pole connected to the pull-down node PD.

The pull-down unit comprises: a pull-down transistor M6, with its gate connected to the pull-down node PD, its first pole connected to the gate drive signal output terminal OUTPUT, and its second pole connected to the low level input terminal.

The pull-up control unit comprises:

an input transistor M7, with its gate and first pole connected to the input terminal INPUT and its second pole connected to the pull-up node PU;

a memory capacitor C1, with its first end connected to the pull-up node PU, and its second end connected to the gate drive signal output terminal OUTPUT, and in the output phase of the display period, the memory capacitor bootstraps a pull-up of the potential of the pull-up node PU;

a pull-up node reset transistor M8, with its gate connected to the pull-down node PD, its first pole connected to the pull-up node PU, and its second pole connected to the low level input terminal, and controlling the potential of the pull-up node PU to be a low level VSS when the potential of the pull-down node PD is of a high level; and a pull-up transistor M9, with its gate connected to the pull-up node PU, its first pole connected to the second clock signal input terminal, and its second pole connected to the gate drive signal output terminal OUTPUT.

The reset unit comprises:

a first reset transistor M10, with its gate connected to the reset terminal RESET, its first pole connected to the pull-up node PU and its second pole connected to the low level input terminal; and a second reset transistor M11, with its gate connected to the reset terminal RESET, its first pole connected to the gate drive signal output terminal OUTPUT, and its second pole connected to the low level input terminal.

In the pull-down holding phase of the display period, the first clock signal CLKB and the second clock signal CLK have opposite phases.

Figure 11:
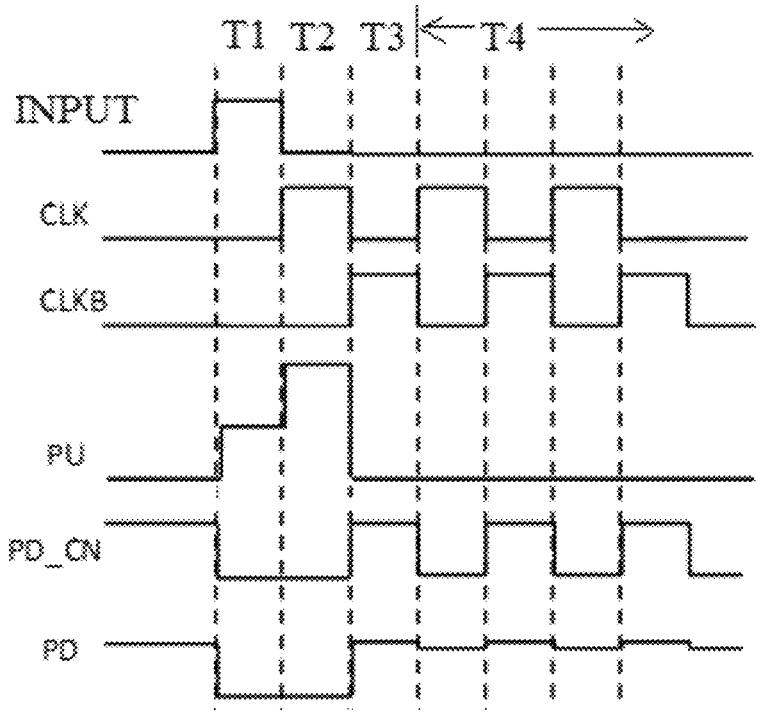
FIG. 11 is a timing diagram of a shift register unit according to one embodiment of the present disclosure.

Referring to FIG. 11, the shift register unit shown in FIG. 10 employs the first pull-down control node control transistor M1 to control the potential of the pull-down control node PD_CN to have a low level when the second clock signal CLK is of a high level. In this way, the potential of the pull-down control node PD_CN is consistent with that of the first clock signal CKB in the pull-down holding phase T4. When the CLKB has a low level and CLK has a high level, the first pull-down control node control transistor M1 is turned on, the potential of PD_CN is pulled down by the low level VSS, and the second pull-down node control transistor M5 is turned off, to prevent electric leakage of the pull-down node PD. That is, in the pull-down holding phase T4, the potential of the pull-down node PD is prevented from being pulled down. Thereby, it is ensured that the potential of the pull-up node PU and the gate drive signal are pulled down to reduce noises of the whole shift register unit.

In FIG. 11, T1 indicates the input phase, T2 indicates the output phase, T3 indicates the pull-down phase and T4 indicates the pull-down holding phase.

Figure 12:
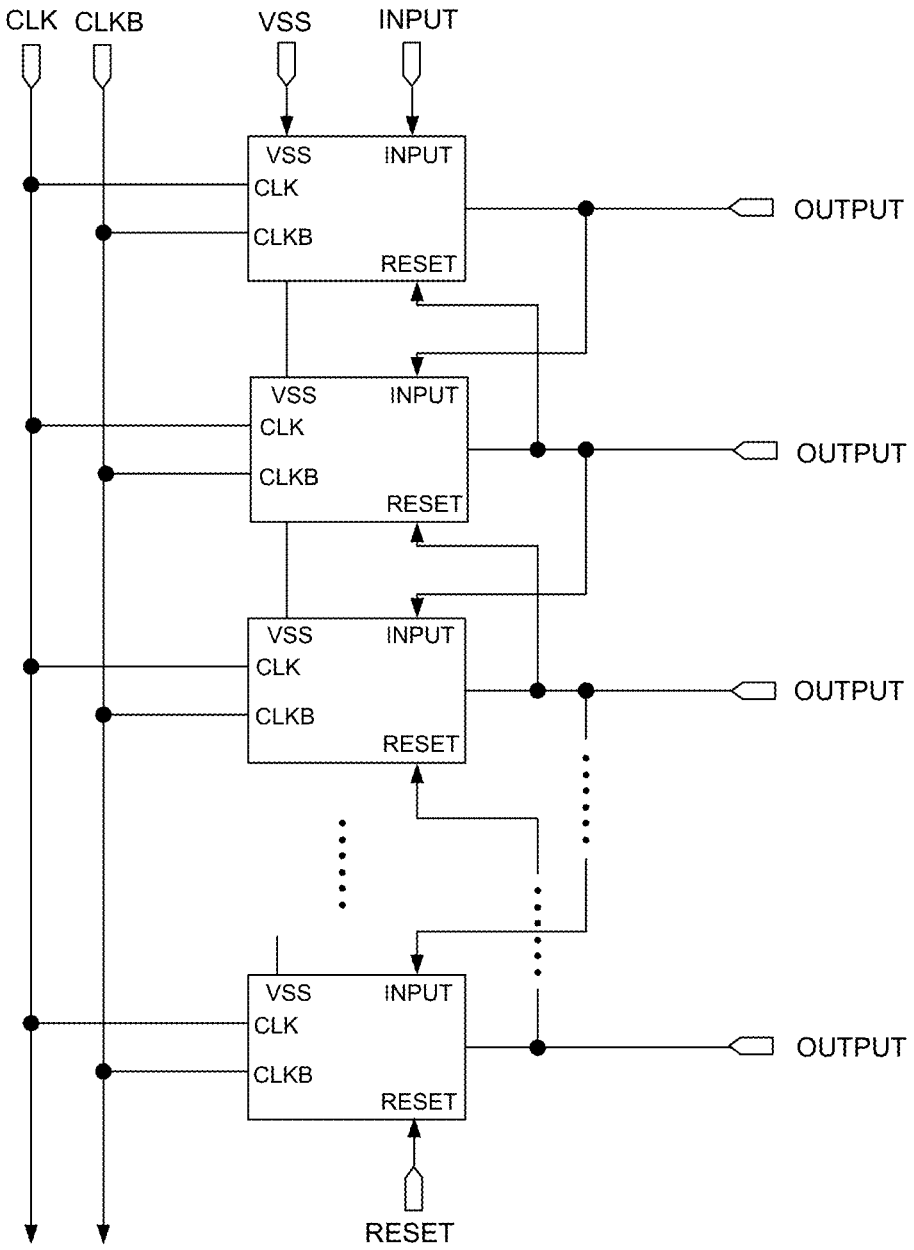
FIG. 12 is a circuit diagram of a gate drive circuit according to one embodiment of the present disclosure.

As shown in FIG. 12, the gate drive circuit comprises multiple stages of the above indicated shift register units.

In the gate drive circuit, each shift register unit comprises a reset terminal and an input terminal. Except for a first stage of shift register unit, the input terminal of each stage of shift register unit is connected the gate drive signal output terminal of a previous adjacent stage of shift register unit. Except for a last stage of shift register unit, the reset terminal of each stage of shift register unit is connected the gate drive signal output terminal of a next adjacent stage of shift register unit.

A display device according to an embodiment of the present disclosure comprises the above-mentioned gate drive circuit.

The above described are embodiments of the present disclosure. It shall be noted that to those ordinarily skilled in the art, many improvements and variations can be made without departing from the principle of the present disclosure. All these improvements and variations shall fall into the protection scope of the present disclosure.

What is claimed is:

1. A shift register unit, comprising:

a gate drive signal output terminal, a first clock signal input terminal, a second clock signal input terminal, a low level input terminal, a pull-up control unit, a pull-down unit, a pull-down node control unit and a pull-down control node control unit;

a pull-up node disposed between the pull-up control unit and the pull-down node control unit;

a pull-down node disposed between the pull-down unit and the pull-down node control unit; and a pull-down control node disposed between the pull-down control node control unit and the pull-down node control unit, wherein the pull-up control unit is connected to the gate drive signal output terminal and the pull-up node, and in an input phase and output phase of a display period, the pull-up control unit pulls a potential of the pull-up node up to a high level, and in the output phase of the display period, the pull-up control unit controls the gate drive signal output terminal to output a high level, the pull-down unit is connected to the pull-down node and the gate drive signal output terminal, and in a pull-down holding phase of the display period, the pull-down unit controls the gate drive signal output terminal to output a low level under the control of the pull-down node, the pull-down node control unit is connected to the first clock signal input terminal, the pull-up node, the pull-down node, the pull-down control node and the low-level input terminal, and in the input phase and output phase of the display period, the pull-down node control unit controls the pull-down node to be connected to the low-level input terminal under the control of the pull-up node, and in the pull-down holding phase of the display period, the pull-down node control unit controls the pull-down node to be connected to the first clock signal input terminal under the control of the pull-down control node, and the pull-down control node control unit is connected to the first clock signal input terminal, the second clock signal input terminal, the low level input terminal and the pull-down control node, and in the pull-down holding phase of the display period, a first clock signal input through the first clock signal input terminal and a second clock signal input through the second clock signal input terminal have opposite phases, under the condition the first clock signal has a high level, the pull-down control node control unit controls the pull-down control node to be connected to the first clock signal input terminal, and under the condition the second clock signal has a high level, the pull-down control node control unit controls the pull-down control node to be connected to the low level input terminal.

2. The shift register unit according to claim 1, wherein the pull-down control node control unit comprises a first pull-down control node control module and a second pull-down control node control module, wherein the first pull-down control node control module is connected to the pull-down control node, the second clock signal input terminal and the low level input terminal, and in the pull-down holding phase of the display period, under the condition the second clock signal has a high level, the first pull-down control node control module controls the pull-down control node to be connected to the low-level input terminal, and the second pull-down control node control module is connected to the first clock signal input terminal and the pull-down control node, and in the pull-down holding phase of the display period, under the condition the first clock signal has a high level, the second pull-down control node control module controls the pull-down control node to be connected to the first clock signal input terminal.

3. The shift register unit according to claim 2, wherein the first pull-down control node control module comprises a first pull-down control node control transistor, with its gate connected to the second clock signal input terminal, its first pole connected to the pull-down control node, and its second pole connected to the low level input terminal.

4. The shift register unit according to claim 2, wherein the second pull-down control node control module comprises a second pull-down control node control transistor, with its gate and first pole both connected to the first clock signal input terminal, and its second pole connected to the pull-down control node.

5. The shift register unit according to claim 2, wherein the pull-down control node control unit further comprises a third pull-down control node control module connected to the pull-down control node, the pull-up node and the low level input terminal, and in the input phase and output phase of the display period, the third pull-down control node control module controls the pull-down control node to be connected to the low level input terminal under the control of the pull-up node.

6. The shift register unit according to claim 5, wherein the third pull-down control node control module comprises a third pull-down control node control transistor, with its gate connected to the pull-up node, its first pole connected to the pull-down control node, and its second pole connected to the low level input terminal.

7. The shift register unit according to claim 1, wherein the pull-down node control unit comprises:

a first pull-down node control transistor, with its gate connected to the pull-up node, its first pole connected to the pull-down node and its second pole connected to the low level input terminal; and a second pull-down node control transistor, with its gate connected to the pull-down control node, its first pole connected to the first clock signal input terminal, and its second pole connected to the pull-down node.

8. The shift register unit according to claim 1, wherein the pull-down unit comprises:

a pull-down transistor, with its gate connected to the pull-down node, its first pole connected to the gate drive signal output terminal, and its second pole connected to the low level input terminal.

9. The shift register unit according to claim 1, further comprising an input terminal, and the pull-up control unit comprises an input module, a memory capacitor, a pull-up node reset module and a pull-up module, wherein the input module is connected to the input terminal and the pull-up node, and in the input phase of the display period, the input module pulls a potential of the pull-up node to a high level, a first end of the memory capacitor is connected to the pull-up node, and a second end of the memory capacitor is connected to the gate drive signal output terminal, and in the output phase of the display period, the memory capacitor bootstraps a pull-up of a potential of the pull-up node, the pull-up node reset module is connected to the pull-down node, the pull-up node and the low level input terminal, and under the condition a potential of the pull-down node has a high level, the pull-up node reset module controls a potential of the pull-up node to be a low level, and the pull-up module is connected to the pull-up node, the second clock signal input terminal and the gate drive signal output terminal, and under the condition a potential of the pull-up node has a high level, the pull-up module controls the gate drive signal output terminal to be connected to the second clock signal input terminal.

10. The shift register unit according to claim 9, wherein the input module comprises an input transistor, with its gate and first pole connected to the input terminal, and its second pole connected to the pull-up node, the pull-up node reset module comprises a pull-up node reset transistor, with its gate connected to the pull-down node, its first pole connected to the pull-up node and its second pole connected to the low level input terminal, the pull-up module comprises a pull-up transistor, with its gate connected to the pull-up node, its first pole connected to the second clock signal input terminal and its second pole connected to the gate drive signal output terminal.

11. The shift register unit according to claim 1, further comprising a reset terminal and a reset unit, wherein the reset unit is connected to the reset terminal, the pull-up node, the gate drive signal output terminal and the low level input terminal, and under the condition signals input through the reset terminal have a high level, the reset unit controls the pull-up node and the gate drive signal output terminal to be both connected to the low level input terminal.

12. The shift register unit according to claim 11, wherein the reset unit comprises:

a first reset transistor, with its gate connected to the reset terminal, its first pole connected to the pull-up node and its second pole connected to the low level input terminal; and a second reset transistor, with its gate connected to the reset terminal, its first pole connected to the gate drive signal output terminal and its second pole connected to the low level input terminal.

13. A gate drive circuit, comprising multiple stages of the shift register units according to claim 1.

14. The gate drive circuit according to claim 13, wherein each shift register unit comprises a reset terminal and an input terminal, and except for a first stage of shift register unit, the input terminal of each stage of shift register unit is connected to the gate drive signal output terminal of a previous adjacent stage of shift register unit, and except for a last stage of shift register unit, the reset terminal of each stage of shift register unit is connected to the gate drive signal output terminal of a next adjacent stage of shift register unit.

15. A display device, comprising the gate drive circuit according to claim 13.

16. A display device, comprising the gate drive circuit according to claim 14.

17. The gate drive circuit according to claim 13, wherein the pull-down control node control unit comprises a first pull-down control node control module and a second pull-down control node control module, wherein the first pull-down control node control module is connected to the pull-down control node, the second clock signal input terminal and the low level input terminal, and in the pull-down holding phase of the display period, under the condition the second clock signal has a high level, the first pull-down control node control module controls the pull-down control node to be connected to the low-level input terminal, and the second pull-down control node control module is connected to the first clock signal input terminal and the pull-down control node, and in the pull-down holding phase of the display period, under the condition the first clock signal has a high level, the second pull-down control node control module controls the pull-down control node to be connected to the first clock signal input terminal.

18. The gate drive circuit according to claim 13, wherein the pull-down node control unit comprises:

a first pull-down node control transistor, with its gate connected to the pull-up node, its first pole connected to the pull-down node and its second pole connected to the low level input terminal; and a second pull-down node control transistor, with its gate connected to the pull-down control node, its first pole connected to the first clock signal input terminal, and its second pole connected to the pull-down node.

19. The gate drive circuit according to claim 13, wherein the pull-down unit comprises:

a pull-down transistor, with its gate connected to the pull-down node, its first pole connected to the gate drive signal output terminal, and its second pole connected to the low level input terminal.

20. The gate drive circuit according to claim 13, further comprising an input terminal, and the pull-up control unit comprises an input module, a memory capacitor, a pull-up node reset module and a pull-up module, wherein the input module is connected to the input terminal and the pull-up node, and in the input phase of the display period, the input module pulls a potential of the pull-up node to a high level, a first end of the memory capacitor is connected to the pull-up node, and a second end of the memory capacitor is connected to the gate drive signal output terminal, and in the output phase of the display period, the memory capacitor bootstraps a pull-up of a potential of the pull-up node, the pull-up node reset module is connected to the pull-down node, the pull-up node and the low level input terminal, and under the condition a potential of the pull-down node has a high level, the pull-up node reset module controls a potential of the pull-up node to be a low level, and the pull-up module is connected to the pull-up node, the second clock signal input terminal and the gate drive signal output terminal, and under the condition a potential of the pull-up node has a high level, the pull-up module controls the gate drive signal output terminal to be connected to the second clock signal input terminal.

* * * * *